US011667144B2

(12) United States Patent
Wen et al.

(10) Patent No.: US 11,667,144 B2
(45) Date of Patent: Jun. 6, 2023

(54) BOOKMARKING DEVICE

(71) Applicants: Brian C Wen, Folsom, CA (US); Jennifer C Wen, Folsom, CA (US)

(72) Inventors: Brian C Wen, Folsom, CA (US); Jennifer C Wen, Folsom, CA (US)

( * ) Notice: Subject to any disclaimer, the term of this patent is extended or adjusted under 35 U.S.C. 154(b) by 0 days.

(21) Appl. No.: 17/088,529

(22) Filed: Nov. 3, 2020

(65) Prior Publication Data

US 2021/0046776 A1 Feb. 18, 2021

Related U.S. Application Data

(63) Continuation-in-part of application No. 16/430,105, filed on Jun. 3, 2019, now Pat. No. 10,857,827.

(51) Int. Cl.
*B42D 9/00* (2006.01)

(52) U.S. Cl.
CPC ..... *B42D 9/005* (2013.01); *B42D 9/008* (2013.01)

(58) Field of Classification Search
CPC ..... B42D 9/005; B42D 9/008; B42D 9/00
USPC ..... 281/2, 3.1, 5, 10, 12, 15.1, 38, 42
See application file for complete search history.

(56) References Cited

U.S. PATENT DOCUMENTS

2002/0083884 A1* 7/2002 McClosky ..... B42D 3/14 116/235
2005/0173073 A1* 8/2005 Chernoff ..... G09F 3/14 156/556
2005/0180264 A1* 8/2005 Farinella ..... G04G 17/08 368/10
2013/0170329 A1* 7/2013 Estrada ..... G04G 13/026 368/244
2014/0312605 A1* 10/2014 Rabba ..... B42D 9/007 281/42
2018/0300575 A1* 10/2018 Arshad ..... G06K 9/6201

* cited by examiner

*Primary Examiner* — Justin V Lewis

(57) ABSTRACT

A device including a bookmarker for bookmarking pages of a book, the bookmarker having a first and a second end. A locking mechanism locks the first and second ends. A first indicator is operable for indicating a desired portion of the page of the book. A second indicator is operable for indicating an unusual or interesting word on the page. A marker is operable for marking an index page to the corresponding page marked by the front portion of physical bookmark device or a solution page corresponding to a problem containing page marked by the front portion of the bookmarker. A counter for counting down or counting up from a predetermined starting value to a user-set or preset timer value. A motion sensor for determining when a user is reading or otherwise engaged with the page. An alarm for alerting or notifying of the preset timer value being reached.

2 Claims, 9 Drawing Sheets

BOOKMARKING DEVICE

CROSS-REFERENCE TO RELATED APPLICATIONS

The present continuation-in-part patent application claims priority benefit under 35 U.S.C. 120 of the U.S. nonprovisional patent application Ser. No. 16/430,105, "PHYSICAL BOOKMARK", filed on 3 Jun. 2019. The contents of this/these related patent application(s) is/are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a physical bookmark device. More particularly, certain embodiments of the invention relate to a physical bookmark device with an integrated timer alarm.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In many situations, a reader may progress through a book at the reader's own natural pace. Without any other motivating factors, the reader may not progress through a book at a desirable pace, as interferences such as, without limited to, distractions, uninteresting content, tiredness, etc. may impede a reader's progress. This may be especially detrimental while reading textbooks, as deadlines and general reading efficiency may be important when studying.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a variety of conventional bookmarks may be used to mark one's place in books, magazines, and other such physical mediums. The most basic embodiment of a conventional bookmark comprises a sturdy or flexible material placed within book so that a user has reference to a specific page of the book. The conventional bookmark, while simple, may not be secured to the book itself, and may fall out of the book if, for example, without limitation, if a user holds the book from its spine, if the book falls onto the ground, etc.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
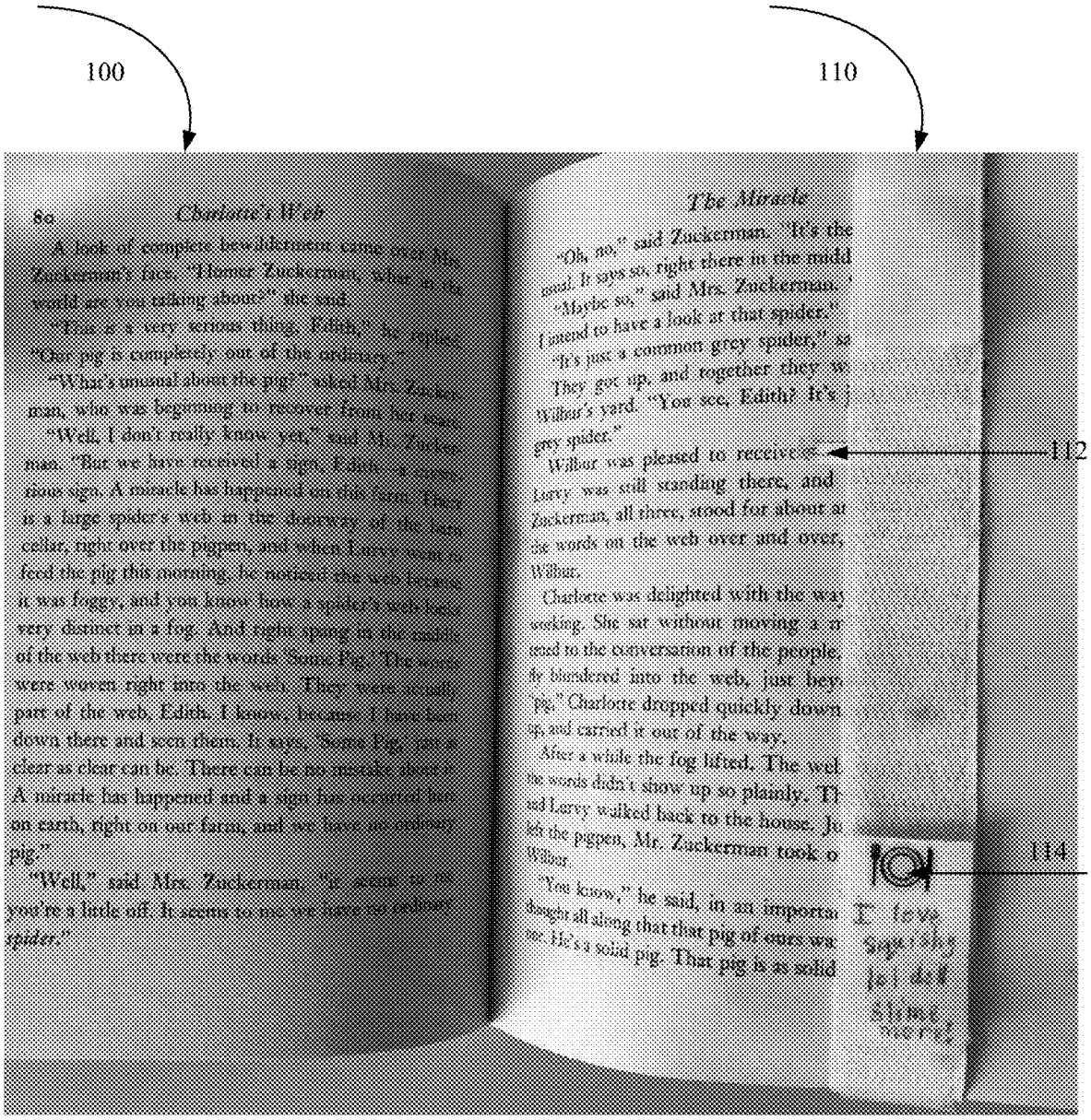
FIG. 1 is an illustration of an exemplary physical bookmark device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hollinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Embodiments of the invention described herein generally relate to a physical bookmark device. More particularly, certain embodiments of the invention relate to a physical bookmark device capable of providing a plurality of indicators in one page of one book. The physical bookmark device disclosed herein may enable a reader to mark a plurality of pages at the same time, while also enabling a reader to mark a plurality of words or lines on the same page.

Accordingly, embodiments of the present invention provide a secure multipage and multiword physical bookmark device to track reading progress for a reader. In one embodiment, is provided a physical bookmark device that may be (i) adjustably secured around a book between two desired pages and (ii) may include a plurality of indicators to point to a desired area on a page to indicate either a last word read or a plurality of important portions of text in a page. Further, in one embodiment, the physical bookmark device may be adjustably secured around a book between two desired pages and may not fall out of the book even if the user holds the book's binding or if the book falls down.

In an exemplary embodiment, an adjustable physical bookmark device is provided. The physical bookmark device may include an elongated flexible strap having a locking mechanism at the ends of the elongated flexible strap, for example, a hook and a loop material on opposing ends. The flexible strap may be adjustably secured around a book between two desired pages using the locking mechanism, enabling a reader/user to mark a last page/last word that was read. An indicator is either movably or removably securable to the strap to indicate a last word read or a desired point on the page. In various embodiments, the indicator may include but not be limited to an arrow, a line, a shaped feature like a pointing finger, or fun figures like animals, fruits, cartoons, an opening like a window on the strap, and the like. In various embodiments, the indicator may movably or removably fastened to the strap using fasteners including but not limited to hook and loop material, by a slider that slides into a grove in the indicator and moves back and forth in the groove similar to Ziploc® type fasteners, and the like. In one embodiment, the opening or window may be aligned with a desired word or portion of the page, in order to further identify a word or portion on the page. In certain embodiments, the opening or window may be adjustable along the length or width of a page for marking/identifying a desired work or portion on the page and may include an opening of any suitable shape including, but not limited, to square, rectangle, circle, oval, star shaped, and the like. The physical bookmark device allows users to easily mark both their pages and a plurality of words on the page specifically. In one embodiment, the physical bookmark device may include indicators on both sides of the strap and can mark words or lines on both pages marked by the bookmark device.

FIG. 1 is an illustration 100 of an exemplary physical bookmark device 110, in accordance with an embodiment of the present invention. The physical bookmark device 110 includes a removably fixed arrow mark 112. The physical bookmark device is securely held in place by a locking mechanism 114, i.e., a hoop and loop mechanism. In an exemplary embodiment, the physical bookmark device may be made of an elongated flexible strap, for example a Velcro® strip, cut to a size so as to have sufficient overlap for securing the bookmark. In one embodiment, the physical bookmark device may be personalized by the user. The arrow 112 indicates a desired portion of the page and the bookmark marks the last page read.

Figure 2:
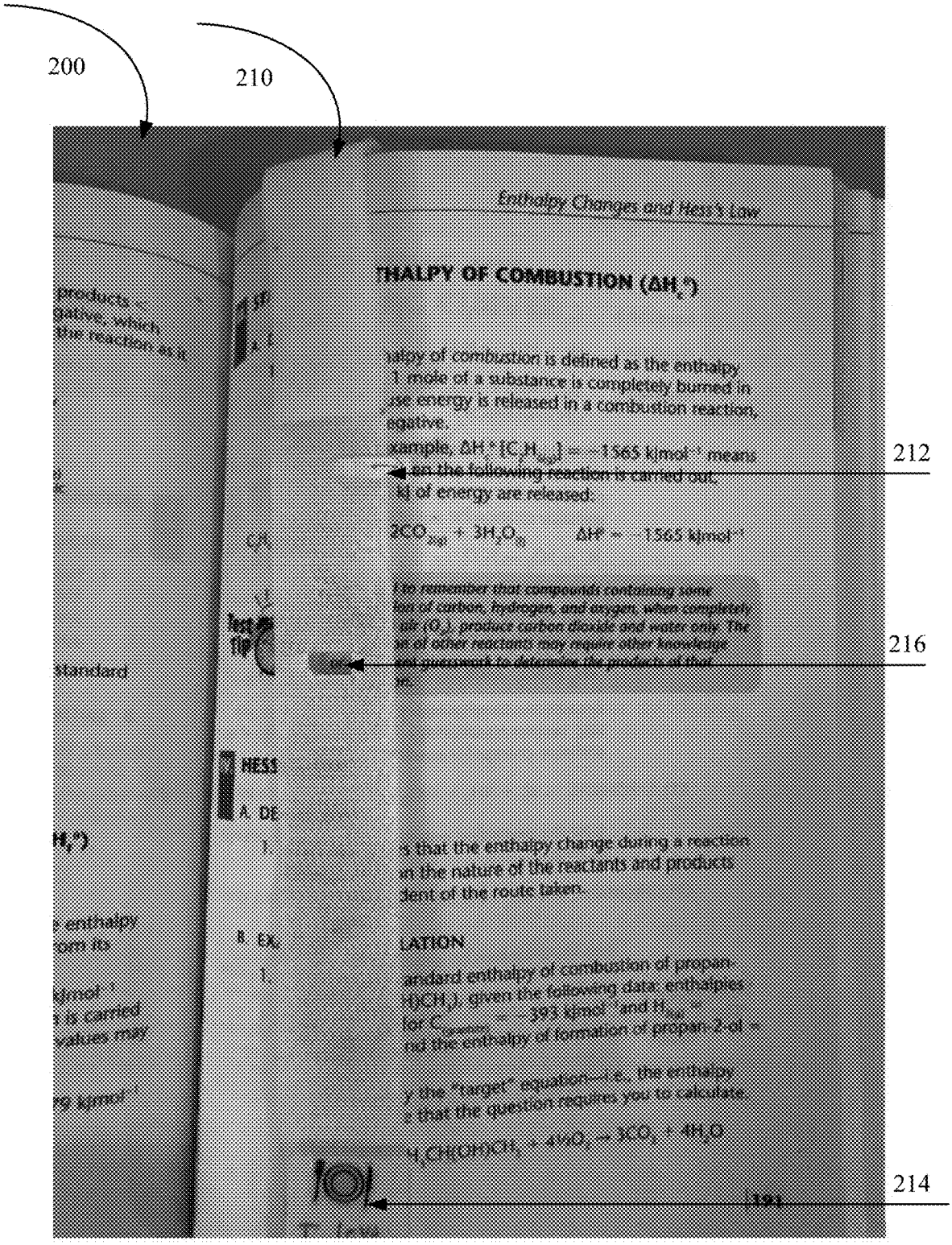
FIG. 2 is an illustration of an exemplary physical bookmark device, in accordance with an embodiment of the present invention.

FIG. 2 is an illustration 200 of an exemplary physical bookmark device 210, in accordance with an embodiment of the present invention. The physical bookmark device 210 includes a removably fixed arrow mark 212. The physical bookmark device is securely held in place by a locking mechanism 214, i.e., a hoop and loop mechanism. In an exemplary embodiment, the physical bookmark device may be made of a Velcro® strip cut to a size so as to have sufficient overlap for securing the bookmark. In one embodiment, the physical bookmark device may be personalized by the user. The arrow 212 indicates a desired portion of the page and the physical bookmark device marks the last page read. As shown in FIG. 1 and FIG. 2 the bookmark may be placed either at the edge of the page with the removably fixed arrow pointing to a portion towards the center of the page (FIG. 1) or towards the center of the page (FIG. 2) with the removably fixed arrow pointing to a portion away from the center of the page. The physical bookmark device 210 shown in FIG. 2 also includes an opening or window 216 to mark another word on the page, which may be of particular interest to the user.

Figure 3:
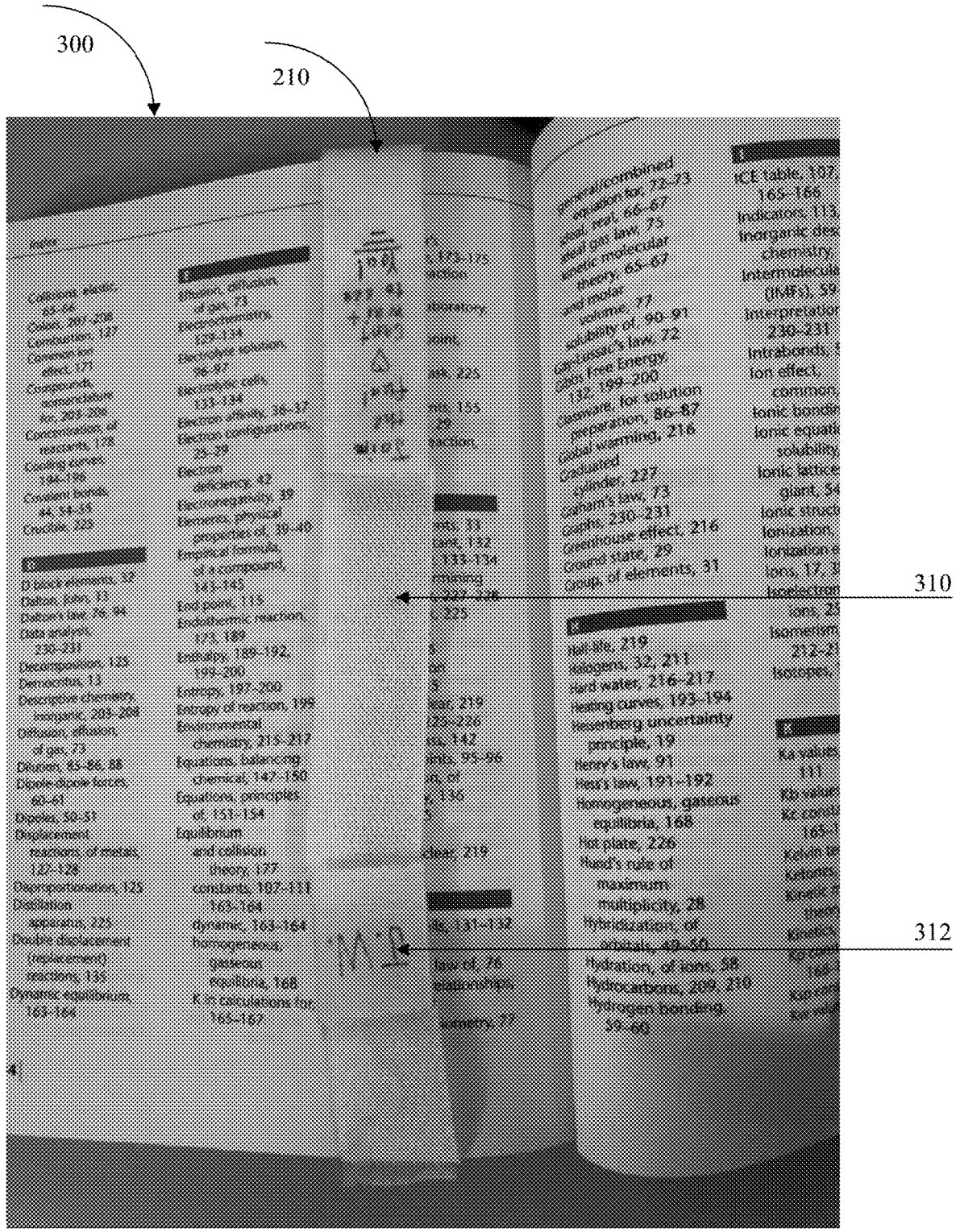
FIG. 3 is an illustration of an exemplary physical bookmark device, in accordance with an embodiment of the present invention.
Figure 4:
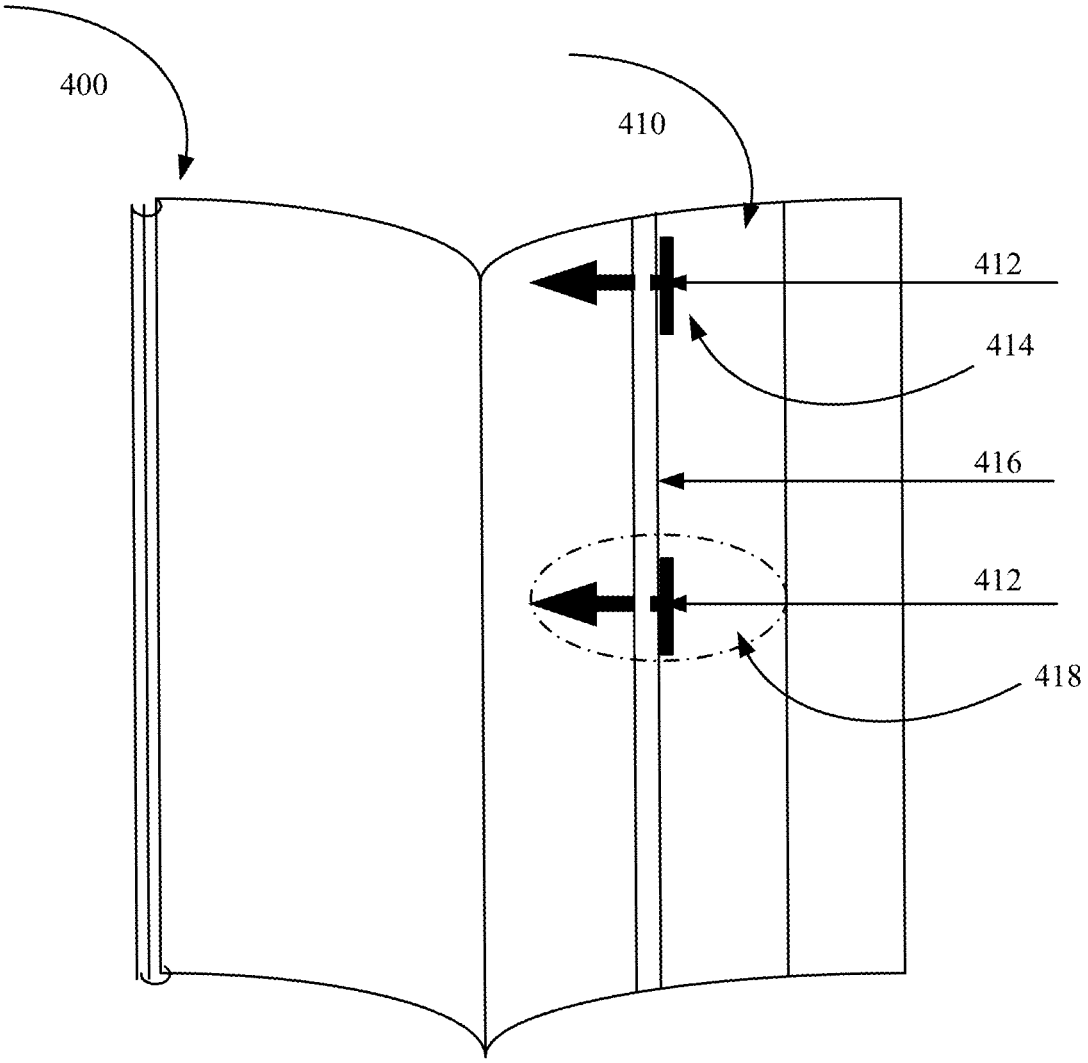
FIG. 4 is an illustration of an exemplary physical bookmark device, in accordance with an embodiment of the present invention.

FIG. 3 is an illustration 300 of an exemplary physical bookmark device 210, in accordance with an embodiment of the present invention. FIG. 3 includes the back portion of bookmark 210 shown in FIG. 2. The back portion of physical bookmark device 210 may include an extension member 310, which may enable the length of bookmark device 210 to be adjusted to fit books of varying sizes. Extension member 310 may be made of a flexible material that can engage with end portions of bookmark device 210, for example without limitation hook and loop material such as Velcro®. The back portion of physical bookmark device 210 may be used to mark another page, such as for example an index page to the corresponding page marked by the front portion of physical bookmark device 210 in FIG. 2, or to mark a solution page corresponding to a problem containing page marked by the front portion of physical bookmark device 210, or two totally unconnected pages if two users are using the book simultaneously and would like to mark the last page read by each user by using a marker 312 that may include their initials or a personal mark on physical bookmark device 210 indicating their last page read or last word read, and the like. In certain embodiments, (not shown in figure) the physical bookmark device may include both or one type of indicator on both sides of the strap without causing hindrance to the locking mechanism FIG. 4 is an illustration 400 of an exemplary physical bookmark device 410, in accordance with an embodiment of the present invention. The physical bookmark device 410 includes a movably fixed arrow mark 412 which may slide over a groove or slider 416 to be held in a first position 414 or in a second position 418. In some embodiments, the arrow mark 412, which may act as a pointer, may be able to extend in the horizontal direction similar to an extendable ruler. It will be appreciated by a person with ordinary skill in the art, in light of and in accordance with the teachings of the present invention, that there may be a plurality of movably fixed arrow marks 412 on the slider 416 depending on size of the book and the user's requirement. The physical bookmark device is securely held in place by a hoop and lock mechanism (not shown in figure). In an exemplary embodiment, the physical bookmark device may be made of a Velcro® strip cut to a size so as to have sufficient overlap for securing the bookmark. In one embodiment, the physical bookmark device may be personalized by the user. The arrow 412 indicates a desired portion of the page and the physical bookmark device marks the last page read.

Figure 5:
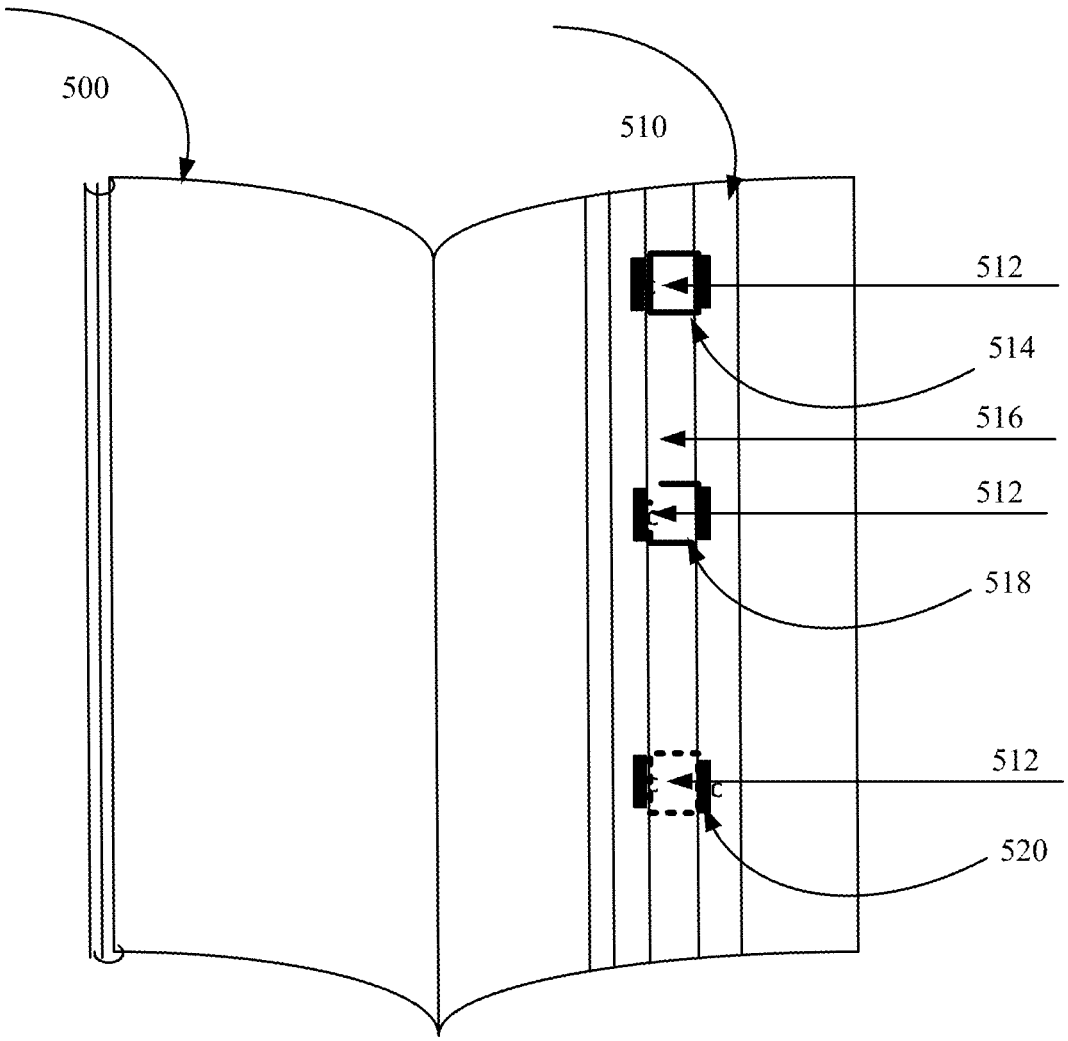
FIG. 5 is an illustration of an exemplary physical bookmark device, in accordance with an embodiment of the present invention.

FIG. 5 is an illustration 500 of an exemplary physical bookmark device 510, in accordance with an embodiment of the present invention. The physical bookmark device 510 includes a movably fixed opening or window 512 which may slide over a groove or slider 516 to be held in a first position 514, in a second position 518, or in a third position 520. It will be appreciated by a person with ordinary skill in the art, in light of and in accordance with the teachings of the present invention, that there may be a plurality of movably fixed windows 512 on the slider 516 depending on size of the book and the user's requirement. The physical bookmark device is securely held in place by a hoop and lock mechanism (not shown in figure). In an exemplary embodiment, the physical bookmark device may be made of a Velcro® strip cut to a size so as to have sufficient overlap for securing the physical bookmark device. In one embodiment, the physical bookmark device may be personalized by the user. The window 512 indicates a desired portion of the page and the physical bookmark device marks the last page read.

Figure 6:
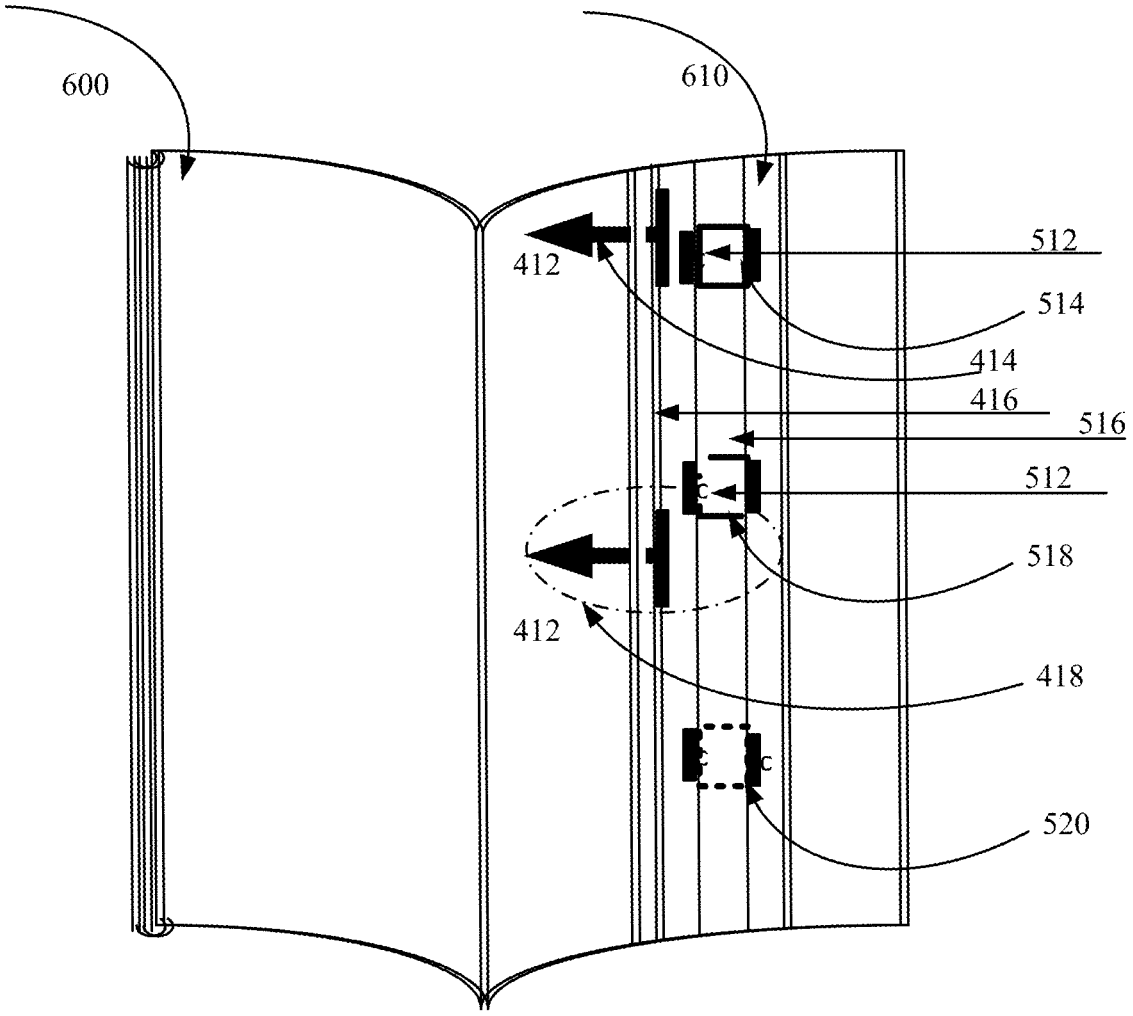
FIG. 6 is an illustration of an exemplary physical bookmark device, in accordance with an embodiment of the present invention.

FIG. 6 is an illustration 600 of an exemplary physical bookmark device 610, in accordance with an embodiment of the present invention. FIG. 6 includes a physical bookmark device having a movably fixed arrow 412 that may be moved to different positions 414, 418 on a slider 416, and a window 512 that may be moved to different positions 514, 518, 520 on a slider 516 as described with reference to FIG. 4 and FIG. 5 above, The physical bookmark device 610 may also include one more removably fixed marker and fixed window as described with reference to FIG. 2 above.

Figure 7:
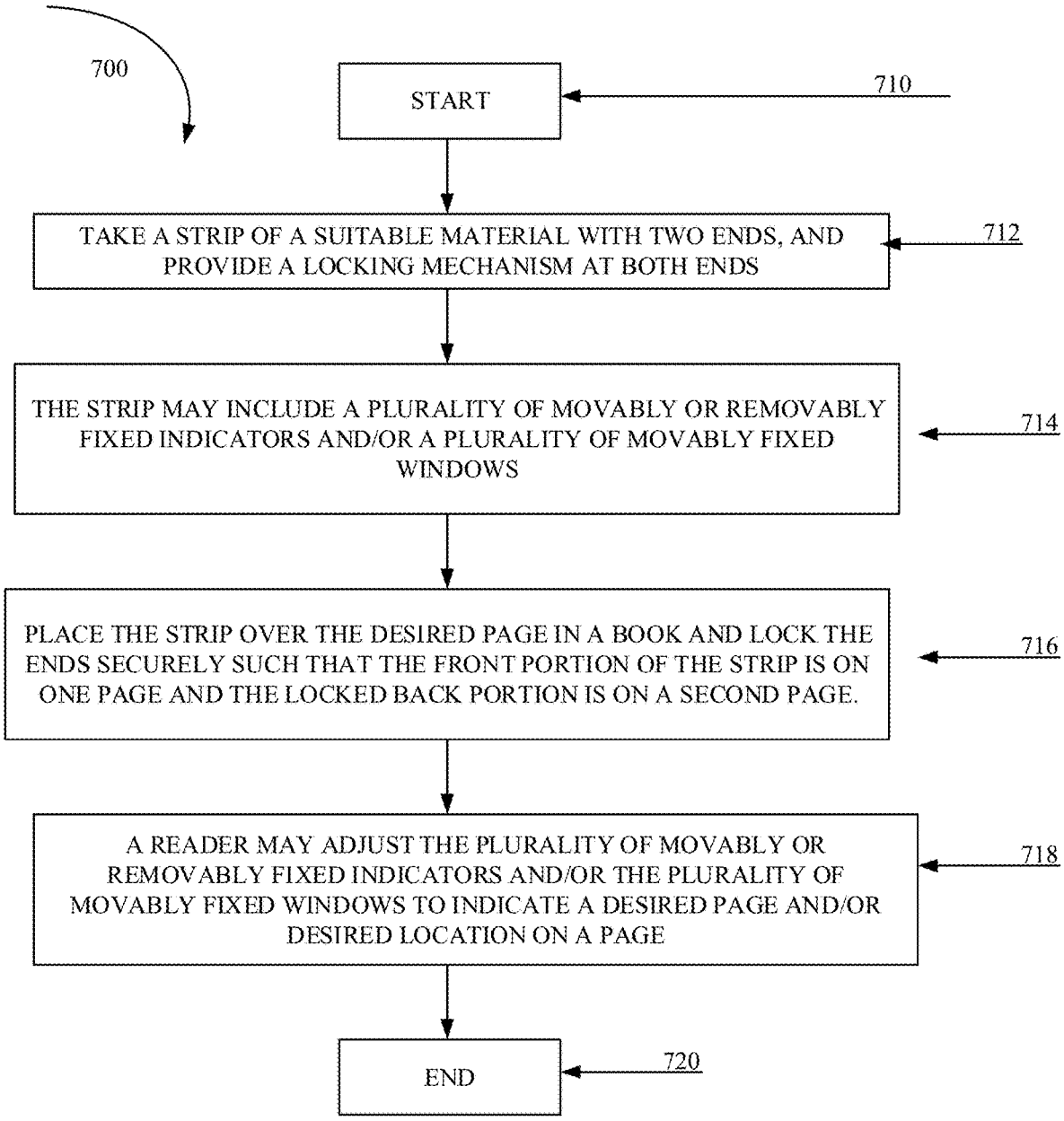
FIG. 7 is a flowchart illustrating a method of making and using an exemplary physical bookmark device, in accordance with an embodiment of the present invention.

FIG. 7 is a flowchart illustrating a method 700 of making and using an exemplary physical bookmark device, in accordance with an embodiment of the present invention. In first step 710 a user starts with making a physical bookmark device. The physical bookmark device may include any one of those discussed with reference to FIGS. 1-6 hereinabove. In a second step 712 the user may take a strip of any suitable material with two ends and provide a locking mechanism at the ends. It will be appreciated by a person with ordinary skill in the art, in light of and in accordance with the teachings of the present invention, that the hook and loop material may be applied along with any other material in the physical bookmark device, including but not limited to, silk, cotton, or elastic material, and the like. The physical bookmark device may look more aesthetic and personalized with other high quality material. In an exemplary embodiment, the physical bookmark device may be made of Velcro®. In a third step 714 the user may proceed to include a plurality of movably or removably fixed indicators and/or a plurality of movably fixed windows on the strip of material. It will be appreciated by a person with ordinary skill in the art, in light of and in accordance with the teachings of the present invention, that the arrow indicator may be a simple line marked on the bookmark as a cost saving manufacturing approach. In a fourth step 716, the user may place the strip over a desired page in a book and lock the ends securely such that the front portion of the strip is on one page and the locked back portion is on a second page. In a fifth step 718, the user/reader may adjust the plurality of movably or removably fixed indicators and/or plurality of movably fixed windows to indicate a desired page and/or desired location on the page. The method ends with the step 720 where the user may close the book or move on to another page in the book with an assurance that the physical bookmark device is secure and the desired page and location on a page is available whenever the user choosed to return to the page.

Figure 8:
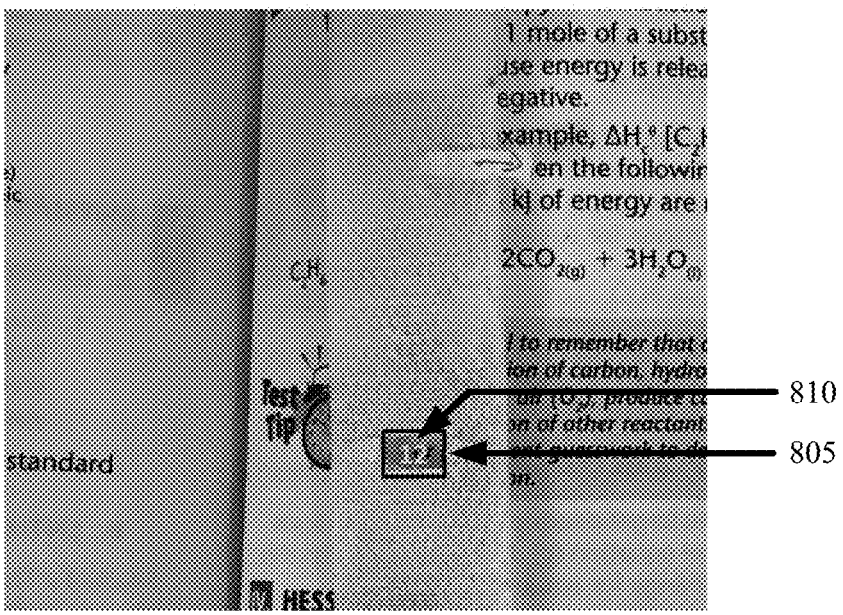
FIG. 8 is an illustration of an exemplary physical bookmark device with an integrated timer alarm, in accordance with an embodiment of the present invention.

FIG. 8 is an illustration of an exemplary physical bookmark device with an integrated timer alarm, in accordance with an embodiment of the present invention. In addition to marking a specific section of a page, opening or window 805 may be integrated with timer alarm 810 such that a user may be alerted to flip a page upon expiry of the timer of timer alarm 810. Timer alarm 810 may include a counter and user interface to count down or count up from a predetermined starting value to a user-set or preset timer value. Upon expiry of the timer value, timer alarm may notify the reader that time has run out. In the preferred embodiment, timer alarm 810 may be integrated into the opening of window 805 as a transparent LCD screen such that a user may see through window 805 with integrated timer alarm 810 and may still track the last word read within window 805. However, as will be appreciated by one skilled in the art, timer alarm 810 may be integrated anywhere on the physical bookmark device, and is not limited to being integrated within window 805. For example, without limitation, timer alarm 810 may be integrated on the body of physical bookmark device, in which case timer alarm 810 need not be a transparent LCD screen and may instead use, for example, without limitation, an LCD screen, a dot matrix display screen, an LED screen, a series of integrated LEDs, etc. Additionally, in an alternative embodiment, timer alarm 810 may be removable from physical bookmark device, and may be secured to the physical bookmark device using any means, such as, but not limited to, Velcro®, clips, magnets, etc. In embodiments in which timer alarm 810 is embedded in the bookmark with the screen exposed, typically no housing or casing is required. In embodiments where timer alarm 810 is attached on top of the bookmark, removably or not removably, a housing or casing may be required.

Timer alarm 810 may include a motion sensor in order to determine when a user has flipped a page or has been working on the page in the book, for example making notes or highlighting passages. The motion sensor may be integrated with timer alarm 810 such that once no movement is detected, timer alarm 810 may begin a count down from a user-set or preset timer value. Upon expiry of the timer value, timer alarm 810 may notify the reader that time has run out. The reader may be notified upon the expiry of the timer value by a variety of different means, such as, without limitation, sounding an alarm, flashing a light, vibration of timer alarm 810, flashing a notification, etc. Additionally, a combination of different notifications may be used to alert the reader upon expiry of the timer value of timer alarm 810. The timer value of timer alarm 810 may be adjusted based on the needs of the user, and may be adjustable via a variety of different means. Different types of user interface or input means may include, for example, without limitation, buttons, touch controls, motion control, voice control, etc. Additionally, the timer value of timer alarm 810 may be adjusted wirelessly using a separate device, such as, without limitation, a cell phone, computer, tablet, smart watch, etc. While the different types of user input may be used to adjust the timer value of timer alarm 810, the different types of user input may also be used to adjust other aspects of timer alarm 810, such as, without limitation, brightness, color, mode, volume, notification types, vibration intensity, etc.

Figure 9:
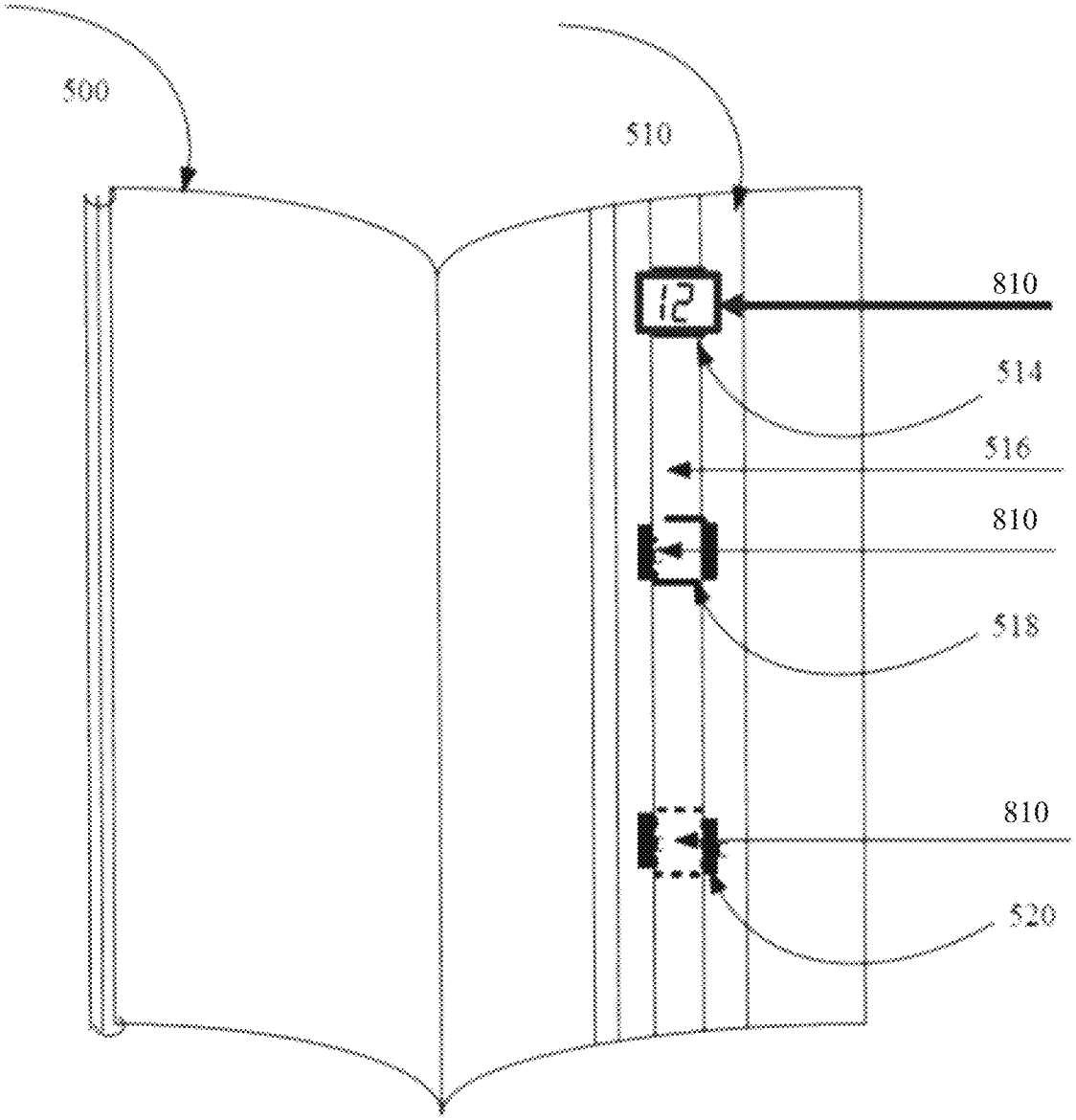
FIG. 9 is an illustration of an exemplary physical bookmark device with an integrated timer alarm, in accordance with an embodiment of the present invention.

FIG. 9 is an illustration of an exemplary physical bookmark device with an integrated timer alarm, in accordance with an embodiment of the present invention. In addition to the base functionality of physical bookmark device 510 as described above, timer alarm 810 may be integrated onto physical bookmark device 510 such that the position of timer alarm 810 may be adjusted depending on the needs of the user. For example, without limitation, timer alarm 810 may be moved to first position 514, second position 518, third position 520, etc. such that timer alarm 810 may be repositioned along the current page of the book. As will be appreciated by one skilled in the art, timer alarm 810 may not be limited to being placed in first position 514, second position 518, or third position 520, and may be placed in any position along the current page of the book.

After timer alarm 810 starts counting down, two different scenarios may occur. In a first scenario, a motion, such as a page flip or working on the page, is not detected and the timer value expires. In response, timer alarm 810 may notify the reader that the timer value has expired using one or more different notification methods, as described above with reference to FIG. 8. In a second scenario, a motion, such as page flip or working on the page, is detected prior to the expiry of the timer value of timer alarm 810. In response, the timer value of timer alarm 810 may be reset, and will not notify the reader. In order to determine whether or not a user has a motion, such as page flip, a motion sensor may be incorporated into timer alarm 810. The motion sensor may include an accelerometer such that the orientation of timer alarm 810 may be detected, and extraneous movement, such as, without limitation, shifting of the user, movement of the book, bumps, etc. may not be registered as the flip of a page, and timer alarm 810 may continue to count down. Alternatively, user input may be used to determine the flip of a page, such as, without limitation, the press of a button or touch screen, etc. Another type of user input may be when a user is working on the page of the book. For example a user may be working on a page full of difficult questions and may not flip the page for a long time. However, since the user continues working on the page, the bookmark device detects the user's movement and does not trigger timer alarm 810 to count down.

In addition to the screen, the motion detector, and the means for user input described above, additional components may be integrated with timer alarm 810. A means for powering timer alarm 810 may be included, and may be, for example, without limitation, one or more disposable or rechargeable batteries, solar panels, solar cells, etc. Additionally, a light source may be integrated onto physical bookmark device 510 or timer alarm 810. The light source may be, for example, without limitation, one or more LEDs, etc. Further, speakers may be integrated into timer alarm 810 to allow for a sound to be used to notify the reader.

While timer alarm 810 may be utilized as a countdown device, timer alarm 810 may also include other modes of operation. For example, without limitation, timer alarm 810 may be used as a stopwatch, wherein timer alarm 810 may time how long a user has been reading. Additionally, physical bookmark device 510 may be used to set a larger reading goal for a user. To set a larger reading goal, the reader may place physical bookmark device 510 at a stopping point within the book. The stopping point may be, for example, without limitation, an ending spot for the current reading session, the start of the next chapter, a variable number of pages ahead, etc. Timer alarm 810 may then be set to a desired time to reach the stopping point, and the user may start timer alarm 810 and start reading. If the user does not reach the stopping point prior to expiry of the timer value of timer alarm 810, timer alarm 810 may notify the user, and adjustments may be made. Additionally, timer alarm 810 may function as a simple clock, and display the time to the user as the user is reading.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a physical bookmark according to the present invention will be apparent to those skilled in the art. Various aspects of the invention have been described above by way of illustration, and the specific embodiments disclosed are not intended to limit the invention to the particular forms disclosed. The particular implementation of the physical bookmark may vary depending upon the particular context or application. By way of example, and not limitation, the physical bookmark described in the foregoing were principally directed to reading timing and alarm implementations; however, similar techniques may instead be applied to study timers, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

Only those claims which employ the words "means for" or "steps for" are to be interpreted under 35 USC 112, sixth paragraph (pre AIA) or 35 USC 112(f) post-AIA. Otherwise, no limitations from the specification are to be read into any claims, unless those limitations are expressly included in the claims.

What is claimed is:

1. A device comprising:

a bookmarker for bookmarking pages of a book, said bookmarker having a first and a second end, said bookmarker further having front and back portions;

a locking mechanism for locking said first and second ends to each other, said locking mechanism comprises a hoop and loop mechanism;

a first indicator for indicating a desired portion of a page of said book;

a second indicator for indicating a particular word on the page;

a first marker for marking a first page of the book with the front portion of said bookmarker and a second marker for simultaneously marking a second page of the book with the back portion of said bookmarker;

a counter for counting down or counting up from a predetermined starting value to a user-set or preset timer value;

a motion sensor for determining when a user is reading or otherwise engaged with the page;

an alarm for alerting or notifying of said preset timer value being reached, said alarm comprises at least one of sounding an alarm, flashing a light, vibrating said alarm, and flashing a notification;

a first groove that is configured to be operable for sliding said first indicator; and a second groove that is configured to be operable for sliding said second indicator.

2. The device of claim 1, further comprising a transparent LCD.

* * * * *